US012378642B2

(12) United States Patent
Palanivel et al.

(10) Patent No.: US 12,378,642 B2
(45) Date of Patent: Aug. 5, 2025

(54) ALUMINUM ALLOYS FOR DIE CASTING

(71) Applicant: Tesla, Inc., Palo Alto, CA (US)

(72) Inventors: Sivanesh Palanivel, San Jose, CA (US); Charlie Kuehmann, Los Gatos, CA (US); Jason Robert Stucki, Livermore, CA (US); Ethan Filip, Los Altos, CA (US); Paul K. Edwards, Seattle, WA (US)

(73) Assignee: Tesla, Inc., Austin, TX (US)

( * ) Notice: Subject to any disclaimer, the term of this patent is extended or adjusted under 35 U.S.C. 154(b) by 760 days.

(21) Appl. No.: 17/264,537

(22) PCT Filed: Aug. 1, 2019

(86) PCT No.: PCT/US2019/044764

§ 371 (c)(1),
(2) Date: Jan. 29, 2021

(87) PCT Pub. No.: WO2020/028730

PCT Pub. Date: Feb. 6, 2020

(65) Prior Publication Data

US 2021/0332461 A1 Oct. 28, 2021

Related U.S. Application Data

(60) Provisional application No. 62/713,805, filed on Aug. 2, 2018.

(51) Int. Cl.

| | |
|---|---|
| ***C22C 21/00*** | (2006.01) |
| ***B22D 21/00*** | (2006.01) |
| ***B22D 25/06*** | (2006.01) |

(52) U.S. Cl.
CPC ..... *C22C 21/00* (2013.01); *B22D 21/007* (2013.01); *B22D 25/06* (2013.01)

(58) Field of Classification Search
CPC ..... C22C 21/00; B22D 21/007; B22D 25/06; B22D 11/003; B22D 19/0054; C22F 1/04
(Continued)

(56) References Cited

U.S. PATENT DOCUMENTS

| | | | |
|---|---|---|---|
| 3,392,015 | A | 7/1968 | Badia et al. |
| 4,397,696 | A | 8/1983 | Vasudevan |

(Continued)

FOREIGN PATENT DOCUMENTS

| | | |
|---|---|---|
| CN | 1107897 | 9/1995 |
| CN | 101787454 | 7/2010 |

(Continued)

OTHER PUBLICATIONS

JP2000204428A Translation (Year: 1999).*

(Continued)

*Primary Examiner* — Danielle M. Carda
(74) *Attorney, Agent, or Firm* — Schwegman Lundberg & Woessner, P.A.

(57) ABSTRACT

A high performance die castable aluminum alloy is described, wherein the aluminum alloy is characterized as having a high yield strength and high conductivity compared to conventional aluminum alloys, and also a high flowability and low susceptibility to hot tearing when die cast. The aluminum alloy may contain 4-6 wt. % nickel, a yield strength of at least about 90 MPa, and an electrical conductivity of at least about 48% IACS.

20 Claims, 10 Drawing Sheets

(58) Field of Classification Search
USPC ..... 420/551
See application file for complete search history.

(56) References Cited

U.S. PATENT DOCUMENTS

| | | | | |
|---|---|---|---|---|
| 4,866,479 | A * | 9/1989 | Tsukuda | C22C 21/00 430/69 |
| 5,223,050 | A | 6/1993 | Bryant | |
| 5,595,615 | A | 1/1997 | Shibata | |
| 2004/0045638 | A1 | 3/2004 | Garat et al. | |
| 2004/0261916 | A1* | 12/2004 | Lin | C22C 21/00 148/415 |
| 2007/0125460 | A1 | 6/2007 | Lin | |
| 2013/0199680 | A1* | 8/2013 | Apelian | C22C 21/00 420/544 |
| 2015/0307969 | A1 | 10/2015 | Greven et al. | |
| 2018/0305793 | A1 | 10/2018 | Gartner | |
| 2019/0127824 | A1 | 5/2019 | Palanivel et al. | |
| 2019/0185968 | A1 | 6/2019 | Greven et al. | |
| 2021/0332461 | A1 | 10/2021 | Palanivel et al. | |
| 2022/0349034 | A1 | 11/2022 | Palanivel et al. | |

FOREIGN PATENT DOCUMENTS

| | | | | |
|---|---|---|---|---|
| CN | 102333897 | | 1/2012 | |
| CN | 102786955 | | 11/2012 | |
| CN | 104341776 | | 2/2015 | |
| CN | 104357721 | | 2/2015 | |
| CN | 104372216 | | 2/2015 | |
| CN | 104630579 | | 5/2015 | |
| CN | 104962792 | | 10/2015 | |
| CN | 105603272 | | 5/2016 | |
| CN | 107587004 | | 1/2018 | |
| CN | 112567059 | | 3/2021 | |
| EP | 1 471 157 | | 10/2004 | |
| EP | 2 924 137 | | 9/2015 | |
| EP | 3830307 | | 6/2021 | |
| FR | 2827305 | | 1/2003 | |
| JP | 59-123732 | | 7/1984 | |
| JP | 59123732 | A * | 7/1984 | |
| JP | 63-274735 | | 11/1988 | |
| JP | 63274735 | A * | 11/1988 | |
| JP | 64-062432 | | 3/1989 | |
| JP | H062432 | | 1/1994 | |
| JP | 10-147828 | | 6/1998 | |
| JP | 2000204428 | A * | 1/1999 | B22C 9/24 |
| JP | 2000-204428 | | 7/2000 | |
| JP | 2001294962 | | 10/2001 | |
| JP | 2001335901 | | 12/2001 | |
| JP | 2003-155532 | | 5/2003 | |
| JP | 3636027 | B2 * | 4/2005 | C22C 21/00 |
| JP | 4397696 | | 10/2009 | |
| JP | 2017-214655 | | 12/2017 | |
| JP | 2021533260 | | 12/2021 | |
| JP | 202475631 | | 6/2024 | |
| JP | 7510917 | | 7/2024 | |
| KR | 20130067242 | | 6/2013 | |
| KR | 20210038624 | | 4/2021 | |
| KR | 102752889 | | 1/2025 | |
| WO | 2020028730 | | 2/2020 | |

OTHER PUBLICATIONS

Suwanpreecha et al. New generation of eutectic Al—Ni casting alloys for elevated temperature services, Materials Science and Engineering A 709 (Oct. 13, 2017) p. 46-54 (Year: 2017).*
JP3636027B2 Translation (Year: 2005).*
Engin et al., Nov. 19, 2015, The effects of microstructure and growth rate on microhardness, tensile strength, and electrical resistivity for directionally solidified Al—Ni—Fe alloys, Journal of Alloys and Compounds, 660:23-31.
Lu et al., 2010, Development of high search rate and high yield strength gallium alloy, Jiangxi Nonferrous Metals, Issue 3 (abstract).
Pandey et al., Oct. 20, 2017, Development of high-strength high-temperature cast Al—Ni—Cr alloys through evolution of a novel composite eutectic structure, Metallurgical and Materials Transactions A: Physical Metallurgy & Materials Science, 48(12):5940-5050.
Shiharu, Tochi, Feb. 28, 2000, Surface Quantity and Finishing Wood 1st Edition, Beijing Mechanics and Publishing House.
Suwanpreecha et al., Oct. 13, 2017, New generation of eutectic Al—Ni casting alloys for elevated temperature services, Materials Science and Engineering: A, 709:46-54.
International Search Report and Written Opinion dated Oct. 25, 2019 in application No. PCT/US2019/044764.
"Korean Application Serial No. 10-2021-7005652, Notice of Preliminary Rejection mailed Mar. 15, 2024", w English translation, 12 pgs.
"International Application Serial No. PCT US2019 044764, International Preliminary Report on Patentability mailed Feb. 11, 2021", 8 pgs.
"European Application Serial No. 19753559.4, Communication Pursuant to Article 94(3) EPC mailed Nov. 28, 2023", 7 pgs.
"Korean Application Serial No. 10-2021-7005652, Response filed May 16, 2024 to Notice of Preliminary Rejection mailed Mar. 15, 2024", w english claims, 25 pgs.
"European Application Serial No. 19753559.4, Response to Communication pursuant to Rules 161(1) and 162 EPC filed Sep. 17, 2021", 8 pgs.
"European Application Serial No. 19753559.4, Response filed Mar. 22, 2024 to Communication Pursuant to Article 94(3) EPC mailed Nov. 28, 2023", 8 pgs.
"Japanese Application Serial No. 2021-505658, Notification of Reasons for Rejection mailed Aug. 22, 2023", W English Translation, 5 pgs.
"Japanese Application Serial No. 2021-505658, Response filed Sep. 26, 2023 to Notification of Reasons for Rejection mailed Aug. 22, 2023", W English Claims, 8 pgs.
"Japanese Application Serial No. 2021-505658, Examiners Decision of Final Refusal mailed Dec. 5, 2023", W English Translation, 3 pgs.
"Japanese Application Serial No. 2024038605, Notification of Reasons for Refusal mailed May 20, 2025", w English Translation, 9 pgs.

* cited by examiner

ALUMINUM ALLOYS FOR DIE CASTING

INCORPORATION BY REFERENCE TO ANY PRIORITY APPLICATIONS

This application claims the benefit of PCT Patent Application No. PCT/US2019/044764, filed Aug. 1, 2019, entitled "ALUMINUM ALLOYS FOR DIE CASTING" and U.S. Provisional Patent Application No. 62/713,805, filed Aug. 2, 2018, entitled "HIGH PERFORMANCE ALUMINUM ALLOYS WITH ENHANCED CASTABILITY FOR DIE CASTING", each of which are hereby incorporated by reference in their entirety.

BACKGROUND

Field

The present invention relates to aluminum alloys. More specifically, the present invention relates to aluminum alloys with high strength, enhanced conductivity, and improved castability for high-performance applications including automobile parts.

Description of the Related Art

Commercial cast aluminum alloys fall into one of two categories—either possessing high yield strength or possessing high conductivity. For example, the A356 aluminum alloy has a yield strength of greater than 175 MPa, but has a conductivity of approximately 40% IACS. Conversely, the 100.1 aluminum alloy has a conductivity of greater than 48% IACS, but a yield strength of less than 50 MPa. For certain applications, for example, parts within an electric vehicle like a rotor or an inverter, both high strength and conductivity are desired. Further, because it is desired to form these electric-vehicle parts through a casting process, wrought alloys cannot be used. Rather, it is desirable to form the parts through a casting process, such that the parts may be cast quickly and reliably, such as through a low pressure and high velocity metal injection or a high pressure die casting process. After casting, suitable alloys must maintain their properties sufficiently for the necessary application. Poor castability of the alloy often results in observed hot tearing, and can cause fill issues which typically decreases the mechanical and electrical properties of the end cast part.

It may be desirable to produce cast aluminum alloys with high yield strength such that the alloys do not fail easily, while also containing sufficient conductivity for various applications without experiencing significant hot tearing.

SUMMARY

Aluminum alloys that can be cast are described herein. Embodiments of the disclosed aluminum alloys have high yield strengths, high extrusion speeds, high electrical conductivities and/or high thermal conductivities. In some embodiments, the alloys can be used in an as-cast state, which allow for processing without additional and subsequent solution heat treatments, and do not compromise the ability of the aluminum alloy to provide a high yield strength. In one embodiment, the aluminum alloys are designed for use with casting techniques to form products. In some embodiments, die casting is used, although sand casting (green sand and dry sand), permanent mold casting, plaster casting, investment casting, continuous casting, or any other casting techniques may be used.

In some embodiments, the aluminum alloy comprises nickel (Ni) from 4.0 to 6 wt % and the remaining wt % being aluminum (Al) and incidental impurities. In various embodiments, the aluminum alloy comprises nickel (Ni) from 4.0 to 6 wt %, iron (Fe) from 0.2 to 0.8 wt %, titanium (Ti) from 0.01 to 0.1 wt %, the remaining wt % being aluminum (Al) and incidental impurities. In some embodiments, the alloy comprises Ni from 5 to 5.5 wt %. In some embodiments, a motor, such as an electric motor, comprises the alloy described. In some embodiments, the motor includes a rotor comprising the alloy described. In some embodiments, a rotor is made from the alloy comprising Ni from 4.3 to 6 wt %. In other embodiments, a rotor is made from the alloy comprising Ni from 5 to 5.5 wt %. In still other embodiments, the alloy has a yield strength of the alloy is greater than 90 MPa. In some embodiments, the alloy has an electrical conductivity of the alloy is greater than 46% IACS. In other embodiments, the alloy has an electrical conductivity of the alloy is greater than 48% IACS. In one embodiment, the alloy has an electrical conductivity between or between about 46% to 55% IACS. In one embodiment, the aluminum alloy is processed according to a T5 process. In some embodiments, the aluminum alloy is used to form an article or product through a casting or related process.

In one aspect, a cast aluminum alloy is described. The alloy includes Ni from 4 to 6 wt %, and the remaining wt % being Al and incidental impurities. The alloy further has a yield strength of at least about 90 MPa and an electrical conductivity of at least about 48% IACS.

In some embodiments, the alloy further comprises Fe from 0.2 to 0.8 wt %. In some embodiments, the alloy comprises Fe of about 0.3 wt %. In some embodiments, the alloy further comprises Ti from 0.01 to 0.1 wt %. In some embodiments, the alloy comprises Ti of about 0.03 wt %. In some embodiments, the alloy comprises Ni from 4.3 to 6 wt %. In some embodiments, the alloy comprises Ni from 5 to 5.5 wt %. In some embodiments, the alloy comprises Ni of about 5.3 wt %. In some embodiments, the alloy comprises Ni of about 5.1 wt %. In some embodiments, the alloy comprises Ni of about 5.3 wt %, Fe of about 0.3 wt %, and Ti of about 0.03 wt %.

In some embodiments, the incidental impurities are at most about 1 wt %. In some embodiments, the alloy comprises a Si amount in at most as an incidental impurity. In some embodiments, the alloy is substantially absent of Si.

In some embodiments, the alloy is cast into a product. In some embodiments, the product is a portion of an electric motor. In some embodiments, the portion of the electric motor is a rotor. In some embodiments, the motor rotor comprises the alloy of claim 1.

In another aspect, a motor comprising the cast aluminum alloy is described.

In another aspect, a method for producing the cast aluminum alloy is described. The method includes forming a melt that comprises the aluminum alloy, and casting the melt according to a T5 process.

In some embodiments of the method, the aluminum alloy comprises Ni of about 5.3 wt %, Fe of about 0.3 wt %, and Ti of about 0.03 wt %.

Additional embodiments and features are set forth in part in the description that follows, and in part will become apparent to those skilled in the art upon examination of the specification, or may be learned by the practice of the embodiments discussed herein. A further understanding of the nature and advantages of certain embodiments may be realized by reference to the remaining portions of the specification and the drawings, which forms a part of this disclosure.

DETAILED DESCRIPTION

The present disclosure may be understood by reference to the following detailed description, taken in conjunction with the drawings as described below. It is noted that, for purposes of illustrative clarity, certain elements in various drawings may not be drawn to scale, may be represented schematically or conceptually, or otherwise may not correspond exactly to certain physical configurations of embodiments.

Embodiments relate to aluminum alloys useful for creating products. In one embodiment, the alloys were created to provide sufficient castability, and also provide relatively high yield strength and electrical conductivity, as well as improved flowability and resistance to hot tearing or cracking. It was discovered that adding between 4.0 and 6% of nickel to the aluminum metal provided many of these enhancements to for an alloy with the desired features. The aluminum-nickel alloys were found to have high yield strength and high electrical conductivity compared to conventional, commercially available aluminum alloys. As mentioned below, the aluminum alloys are described herein by the weight percent (wt %) of the total elements and particles within the alloy, as well as specific properties of the alloys. It will be understood that the remaining composition of any alloy described herein is aluminum and incidental impurities.

Figure 1:
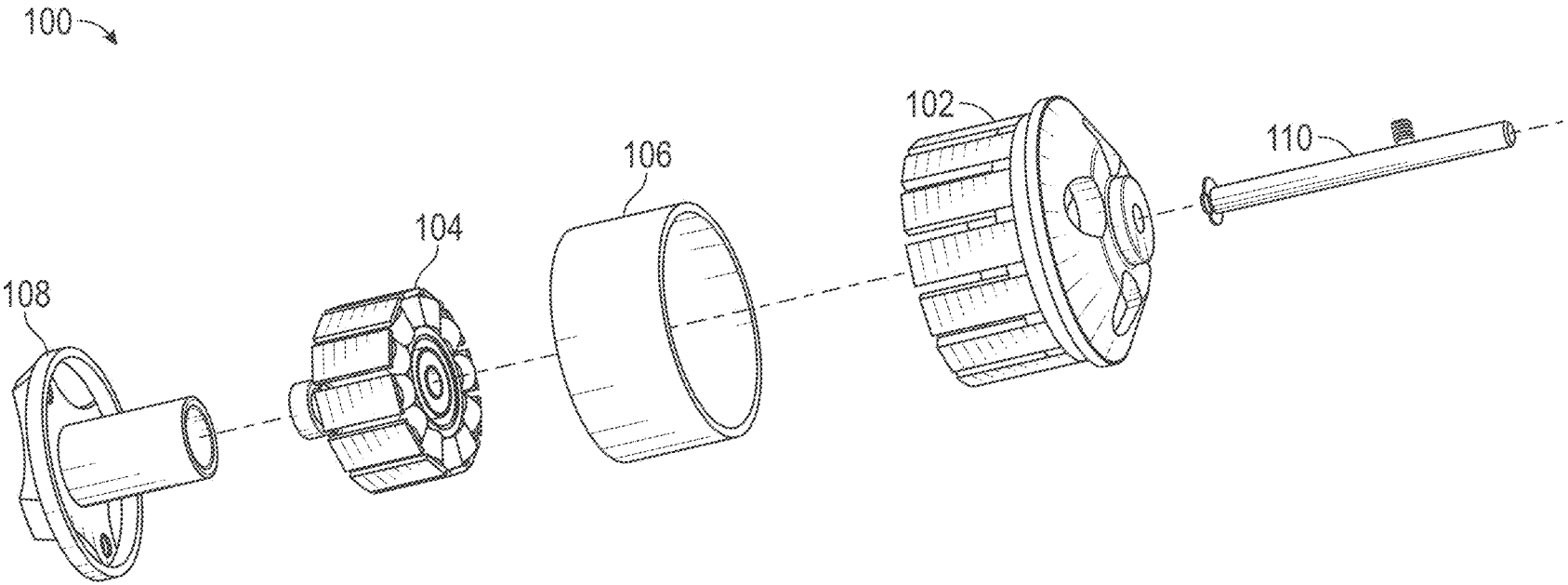
FIG. 1 illustrates and exploded view of an electric motor.

FIG. 1 illustrates and exploded view of an electric motor 100. The electric motor comprises a rotor 102, a stator 104, a housing 106, a mount 108 and a shaft 110. In some embodiments, a motor may comprise an aluminum alloy described herein. In some embodiment, a rotor may comprise an aluminum alloy described herein. In some embodiments, a vehicle, such as an electric vehicle, may comprise the electric motor comprising the aluminum alloy.

Figure 2:
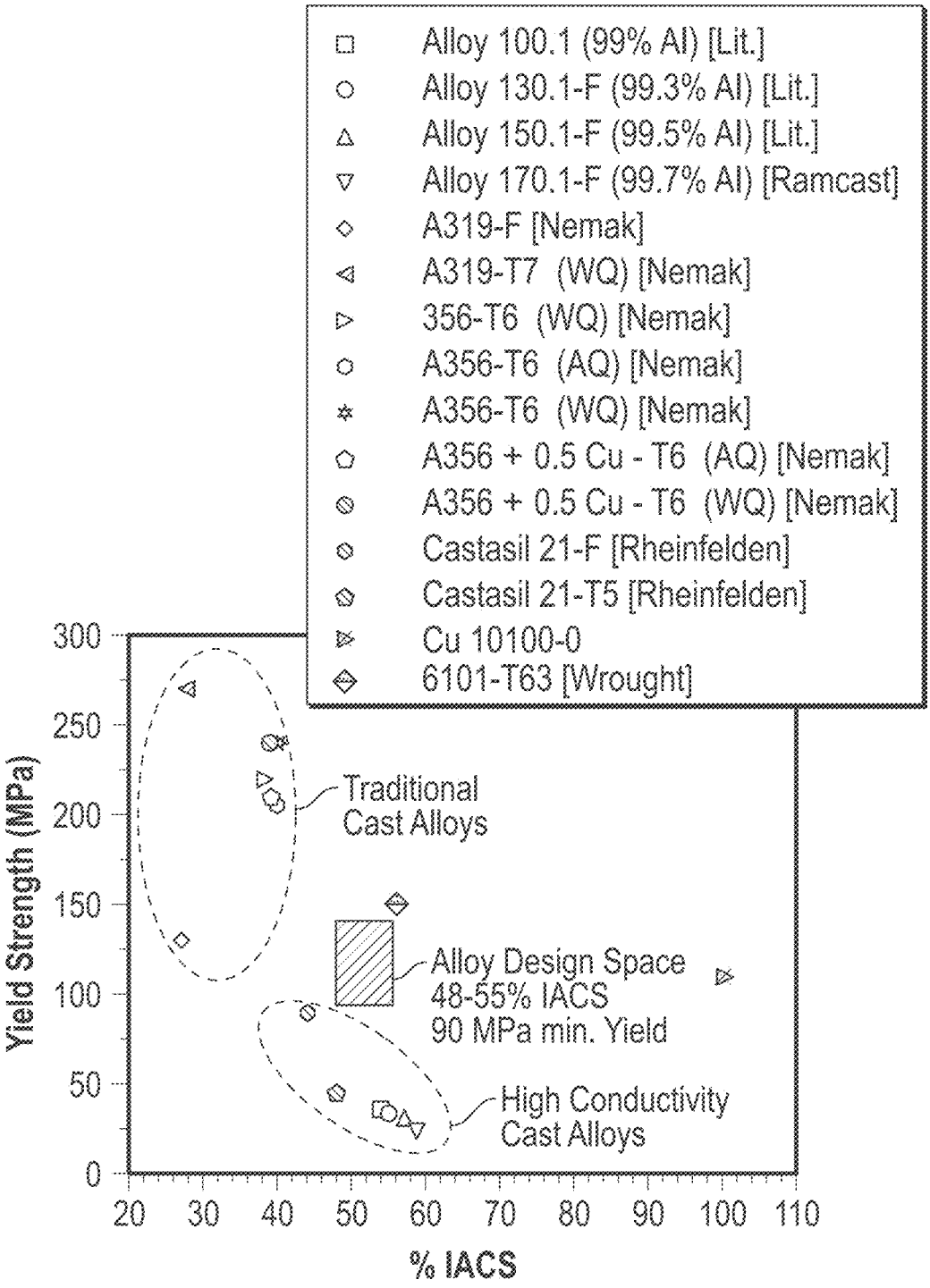
FIG. 2 is a chart that illustrates known cast aluminum alloys, a wrought aluminum alloy, a copper alloy, and the alloy design space of the present disclosure on a yield strength verses conductivity plot.

FIG. 2 illustrates known cast aluminum alloys on a yield strength verses conductivity plot, one wrought aluminum alloy (6101-T63), one copper alloy (10100-0), and an alloy design space of the present disclosure. An aluminum alloy that falls within the alloy design space shown in FIG. 2 would have an electrical conductivity of or of about 48% to 55% International Annealed Copper Standard (IACS), and a minimum yield strength of 90 MPa. In some embodiments, as seen in FIG. 2, the desired yield strength of the alloy design space is between or between about 90 MPa and 130 MPa.

In reference to FIG. 2, aluminum alloys can be grouped into two general groups—those that have high yield strength but low electrical conductivity, and those that have high electrical conductivity but low yield strength. However, it is desirable to have aluminum alloys with performance properties within the alloy design space, and are also castable. In some embodiments, such aluminum alloys may be suitable for certain metal parts within an electric vehicle or an electric motor.

Figure 3:
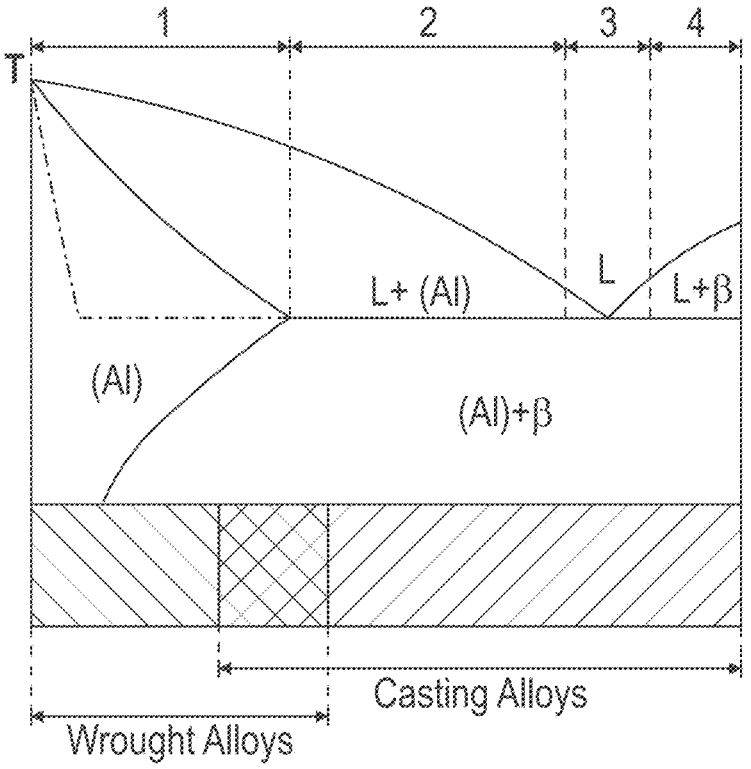
FIG. 3 illustrates a eutectic diagram showing the general range of compositions that are considered for wrought alloys and casting alloys.

FIG. 2 also shows the yield strength and conductivity of the wrought aluminum alloy 6101-T63. The wrought aluminum alloy 6101-T63 is seen to have more desirable performance properties, such as yield strength and electrical conductivity near the design space shown, that are imparted through the wrought alloy processing steps. However, casting alloys are desired for their processability that is not available in wrought alloys. FIG. 3. Illustrates a eutectic diagram that shows the general range of compositions that are considered for wrought alloys and casting alloys. The eutectic point, labeled as L within section 3, is typically considered the most castable composition, with compositions that deviate from the eutectic composition becoming less castable and more likely to be used as wrought alloys.

With continued reference to FIG. 2, Castasil 21-F is a cast commercial alloy with electrical and mechanical properties that are closest to those that of the alloy design space—with an electrical conductivity of 44% IACS and a yield strength of 85 Mpa. However, these properties are still insufficient for creating some parts via casting techniques, such as parts for use in electric vehicles, which require conductivity of at least 48% IACS and yield strength of 90 Mpa or greater.

In addition to sufficient yield strength and electrical conductivity when cast, the cast aluminum alloy must provide sufficient flowability and resistance to hot tearing. In a metal casting process, the metal alloy must have sufficient flowability to flow into and fill all intricacies of the mold. In molds with narrow and/or long mold channels, a sufficiently high flowability of the alloy is required to fill the mold.

Hot tearing is a common and catastrophic defect observed when casting alloys, including aluminum alloys. Without being able to prevent hot tearing in alloy, reliable and reproducible parts cannot be created. Hot tearing is the formation of an irreversible crack while the cast part is still in the semisolid casting. Although hot tearing is often associated with the casting process itself—linked to the creation of thermal stresses during the shrinkage of the melt flow during solidification, the underlying thermodynamics and microstructure of the alloy plays a part.

The present disclosure describes castable aluminum alloy compositions with the desired high yield strength and electrically conductivity that minimize hot tearing and have sufficient flowability to be used in the casting process.

Aluminum Alloy Compositions

Embodiments of the invention relate to casting aluminum alloys with both high yield strength and high conductivity, as well as improved flowability and a resistance to hot tearing or cracking. The aluminum alloys were found to have high yield strength and high electrical conductivity compared to conventional, commercially available aluminum alloys. The aluminum alloys are described herein by the weight percent (wt %) of the total elements and particles within the alloy, as well as specific properties of the alloys. It will be understood that the remaining composition of any alloy described herein is aluminum and incidental impurities.

Impurities may be present in the starting materials or introduced in one of the processing and/or manufacturing steps to create the aluminum alloy. Incidental impurities are compounds and/or elements that do not or do not substantially affect the material properties of the composition, such as yield strength, electrical conductivity, flowability and hot tear resistance. In embodiments, the incidental impurities are less than or equal to approximately 0.2 wt %. In other embodiments, the incidental impurities are less than or equal approximately 1 wt %. In further embodiments, the incidental impurities are less than or equal approximately 0.5 wt %. In still further embodiments, the incidental impurities are less than or equal approximately 0.1 wt %. In some embodiments, Si is an incidental impurity. In some embodiments, Si is present in an amount at most as an incidental impurity. In some embodiments, Si is substantially absent. In some embodiments, Si is absent.

In some embodiments, the aluminum alloy composition comprises Ni in the range of 4.0 to 6 wt %, Fe in the range of 0.2 to 0.8 wt %, Ti in the range of 0.01 to 0.1 wt % with the remaining composition (by wt %) being Al and incidental impurities. In some embodiments, the aluminum alloy composition comprises Ni in the range of 4.3 to 6 wt % or alternatively 5 to 5.5 wt %, Fe in the range of 0.2 to 0.8 wt %, Ti in the range of 0.01 to 0.1 wt % with the remaining composition (by wt %) being Al and incidental impurities.

In some embodiments, the aluminum alloy composition comprises Ni in an amount of or of about 2 wt %, 3 wt %, 3.5 wt %, 4 wt %, 4.2 wt %, 4.3 wt %, 4.5 wt %, 4.7 wt %, 5 wt %, 5.2 wt %, 5.5 wt %, 5.7 wt %, 5.9 wt %, 6 wt %, 6.5 wt %, 7 wt % or 8 wt %, or any range of values therebetween.

In some embodiments, the aluminum alloy composition comprises Fe in an amount of or of about 0.05 wt %, 0.1 wt %, 0.15 wt %, 0.2 wt %, 0.25 wt %, 0.3 wt %, 0.35 wt %, 0.4 wt %, 0.45 wt %, 0.5 wt %, 0.55 wt %, 0.6 wt %, 0.65 wt %, 0.7 wt %, 0.75 wt %, 0.8 wt %, 0.85 wt %, 0.9 wt % or 1 wt %, or any range of values therebetween.

In some embodiments, the aluminum alloy composition comprises Ti in an amount of or of about 0.001 wt %, 0.01 wt %, 0.02 wt %, 0.03 wt %, 0.04 wt %, 0.05 wt %, 0.06 wt %, 0.07 wt %, 0.08 wt %, 0.09 wt %, 0.1 wt %, 0.15 wt %, 0.2 wt %, 0.3 wt % or 0.5 wt %, or any range of values therebetween.

Alloy Performance

The yield strength of the aluminum alloys described herein are at least or at least about 90 MPa. In some embodiments, the yield strength is at least or at least about 90 MPa, 95 MPa, 100 MPa, 110 MPa, 120 MPa, 130 MPa, 140 MPa or 150 MPa, or any range of values therebetween. In one embodiment, the electrical conductivity of the aluminum alloys described herein have at least or at least about 40% IACS. In some embodiments, the aluminum alloys described herein have at least or at least about 40% IACS, 45% IACS, 46% IACS, 48% IACS, 50% IACS, 52% IACS, 55% IACS or 60% IACS, or any range of values therebetween.

Alloy Castability

Industrial applications in which thousands and hundreds-of-thousands of aluminum alloy parts may be cast can require high yield strengths and electrical conductivities. However, the castability of metal alloy should also be considered such that the parts are reproducibly manufacturable by using a casting process.

In one embodiment, the alloy has the proper fluidity to ensure that the alloy wets the entire length of a mold and the mold is properly formed, and such that the alloy resists hot-tearing and retains the desired yield strength when the cast solidifies.

U.S. Provisional App. 62/577,516 focused on aluminum-nickel alloys that produced a desired yield strength and electrical conductivity. U.S. Provisional App. 62/577,516, filed Oct. 26, 2017, is hereby incorporated by reference in its entirety. U.S. Provisional App. 62/577,516 indicated that an aluminum alloy with a nickel composition of 3.5 weight percent and a silicon composition of 1 weight percent resulted in as-cast parts with a yield strength of 110 MPa and an electrical conductivity of 48% IACS. However, the castability of such alloys was improved by the alloys described herein.

To improve castability of aluminum alloys, it is desirable that the other elemental components form a eutectic with aluminum, do not significantly reduce the electrical conductivity of the aluminum, and form strengthening precipitates. Based on the criteria, two candidates to alloy with aluminum to produce the desired castability were found to be nickel (Ni) and cerium (Ce). Nickel formed a eutectic with aluminum at approximately 6% weight percent, whereby cerium and silicon formed a eutectic with aluminum at greater weight percentages. Because it is desirable to include a larger percentage of aluminum in the aluminum alloy for its desirable tensile strength and conductivity, the addition of nickel was found to be more desirable than the addition of cerium.

Including nickel in the aluminum alloy in an amount to reach the eutectic temperature was found to reduce the processing temperature necessary to create a melt for casting, thereby saving energy costs and resources. When casting the alloy, the eutectic reduced the temperature range over which the last 20% of liquid solidifies. To reduce hot tearing, it is desirable for the alloy system to have a relatively small delta T to cool the alloy from 80% solid to 100% solid. Experimental results showed that including Ni in the aluminum alloy in the compositions according to the present invention produced a relatively small delta T and thereby reduced the tendency for cast parts to experience hot tearing.

Elements and Particles

The different elements and particles included as part of the aluminum alloy can alter the properties of the aluminum alloy, and in particular the intermetallic phases. The following descriptions generally describe the effects of including an element in the aluminum alloy.

Ni

In certain embodiments, the aluminum alloy of the present disclosure contains nickel. Nickel may improve hardness and yield strength, and may also reduce the coefficient of expansion.

Fe

In certain embodiments, the aluminum alloy of the present disclosure contains iron. Iron may increase the resistance to die-soldering, thereby increasing the overall tool life. However, iron may negatively impact the mechanical properties of the alloy, including ductility, and fatigue due to tendency to form a detrimental (3 phase.

Ti

In certain embodiments, the aluminum alloy of the present disclosure contains titanium. Titanium may fragment iron intermetallics, change the alloy morphology, and refine grains. The inclusion of titanium into an alloy may help to increase both mechanical properties, for example, yield stress, and also electrical conductivity.

Processing Methods

In some embodiments, a melt for an alloy can be prepared by heating the alloy above the melting temperature of the allow components. After the melt is cast and cooled to room temperature, the alloys may go through various heat treatments, aging, cooling at specific rates, and refining or melting. The processing conditions can create larger or smaller grain sizes, increase or decrease the size and number of precipitates, and help minimize as-cast segregation.

In certain embodiments, the aluminum alloy is cast without further processing. In other embodiments, the as-cast aluminum alloy further processed. In some embodiments, the as-cast aluminum alloy is aged. In certain embodiments, the aluminum alloy is aged according to a T5 process which involves casting followed by cooling (such as air cool, hot water quench, post quench, or another type of quenching or cooling), then 250° C.+/−5° C. for 2 hours+/−15 min (including temperature ramp up and down time), then air cooling. In other embodiments, the aluminum alloy is aged according to a T6 process which involves casting, followed by heating at 540° C.+/−5C for 1.75 hours+/−15 min (including temperature ramp up and down time), then hot water quench, then 225° C. for 2 hours+/−15 min (entire time), then air cooling. In still other embodiments, the aluminum alloy is aged according to a T7 process, which involves casting, followed by heating at 540° C.+/−5C for 1.75 hours+/−15 min (including temperature ramp up and down time), then hot water quench, then 250° C. for 2 hours+/−15 min (entire time), then air cooling.

In certain embodiments, the after the aluminum-alloy melt has been formed, it may be cast into a die to form a high-performance product or part. In some embodiments, product can be part of an automobile, such as parts of an electric motor. In some embodiments, the part of the motor may be a rotor, a stator, a busbar, an inverter, or other electrical motor parts.

EXAMPLES

Material Property Simulations

In order to identify aluminum alloys that may have the desired material properties, computational analyses were conducted. The results of these simulations are summarized in FIGS. 10A-10C.

Figure 9:
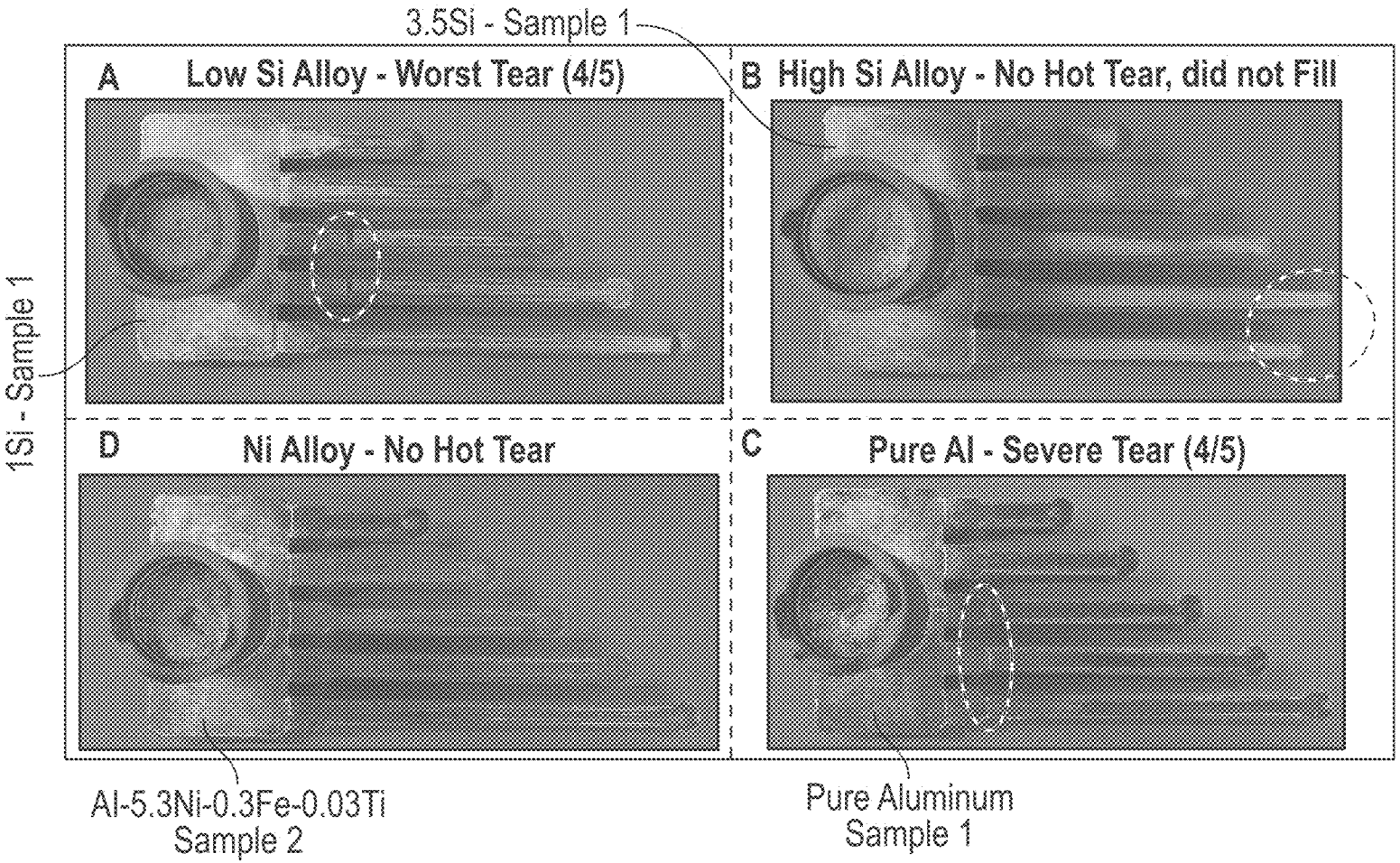
FIG. 9 is a series of images that show experimental hot-tearing-susceptibility results of physical coupons of different alloy compositions in panels A, B, C and D.
Figure 10A:
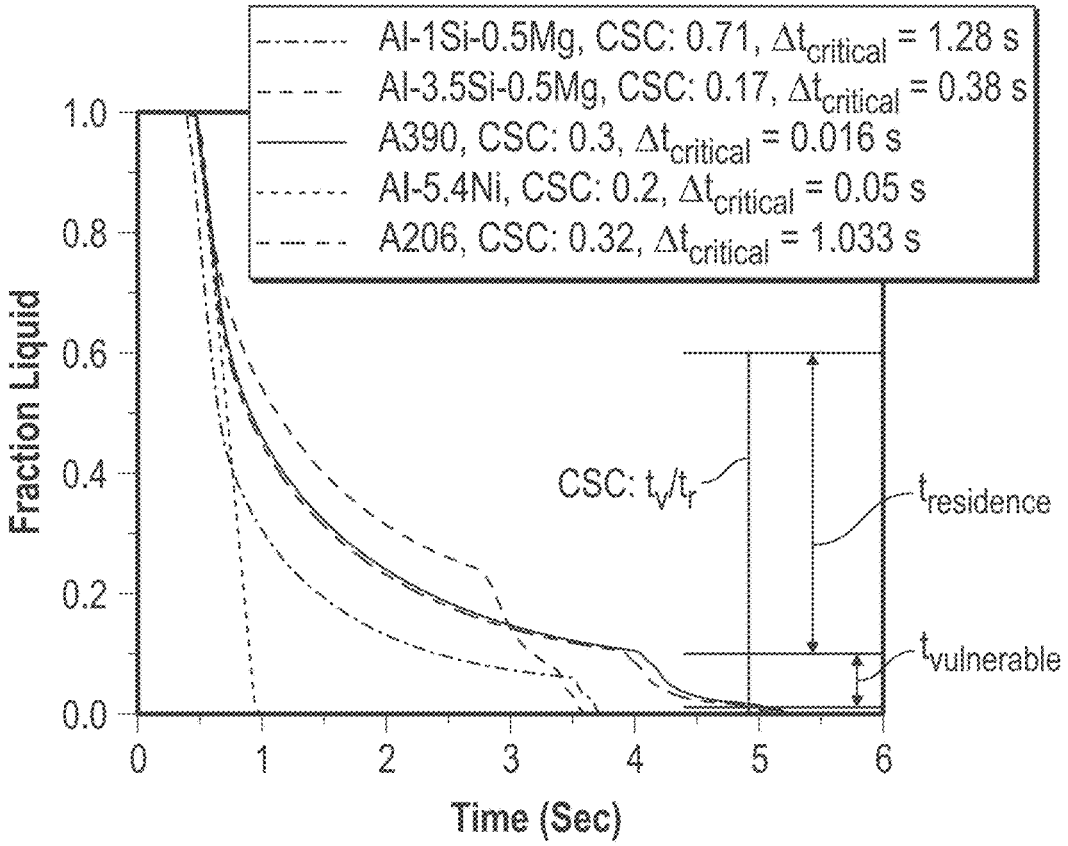
FIG. 10A is a line graph that summarizes computational experiments used to determine the fraction of liquid as a function of time for different alloy compositions.

FIG. 10A summarizes computational experiments that were used to predict the fraction of liquid as a function of time for different potential alloy compositions according to aspects of the present disclosure. CSC is the ratio of $T_{vulnerable}/T_{residence}$. $T_{vulnerable}$ is the vulnerable time during which hot tearing is more likely to occur. $T_{residence}$ is the time when hot cracking is less likely to occur. During this time, the liquid can feed into channels formed during the solidification process and prevent hot tearing. Thus a lower CSC ratio is desirable to prevent hot taring. The aluminum alloy with 5.4% nickel exhibited a CSC ratio of 0.2 compared to aluminum alloy with a CSC ratio of 0.71. The CSC ratio will be dependent on the geometry mold. These calculations were based on the geometry of a mold that would produce the parts shown in FIG. 9. Because this is a difficult geometry for hot tearing, less hot tearing is expected to occur in cast parts formed with less difficult geometries.

Figure 10B:
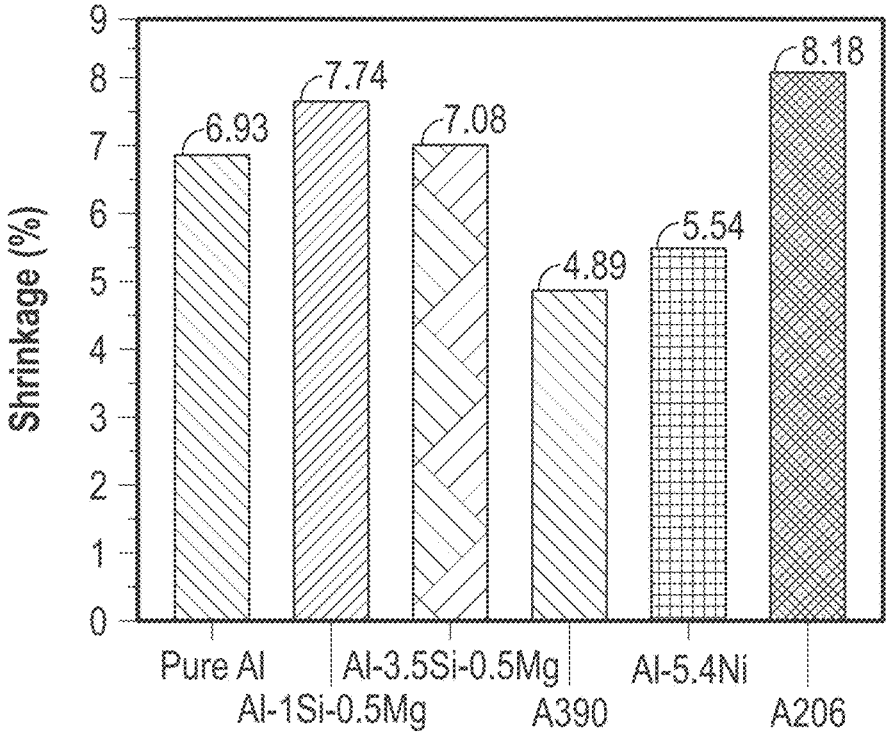
FIG. 10B is a bar chart that summarizes computational experiments used to determine the percentage of shrinkage for different alloy compositions.

FIG. 10B illustrates computational experimental results from shrinkage experiments as the alloy is simulated to cool from the liquidus to the solidus. It is desirable to design an alloy with as little shrinkage from liquidus to solidus as possible. As can be observed, the aluminum alloy with 5.4% nickel performed well and only exhibited 5.54% shrinkage. Minimizing shrinkage is important to keep control part production and keep parts within tolerances. These computational experiments indicated that aluminum alloys with weight percentage of nickel between 4.3-6% exhibit good shrinkage properties.

Figure 10C:
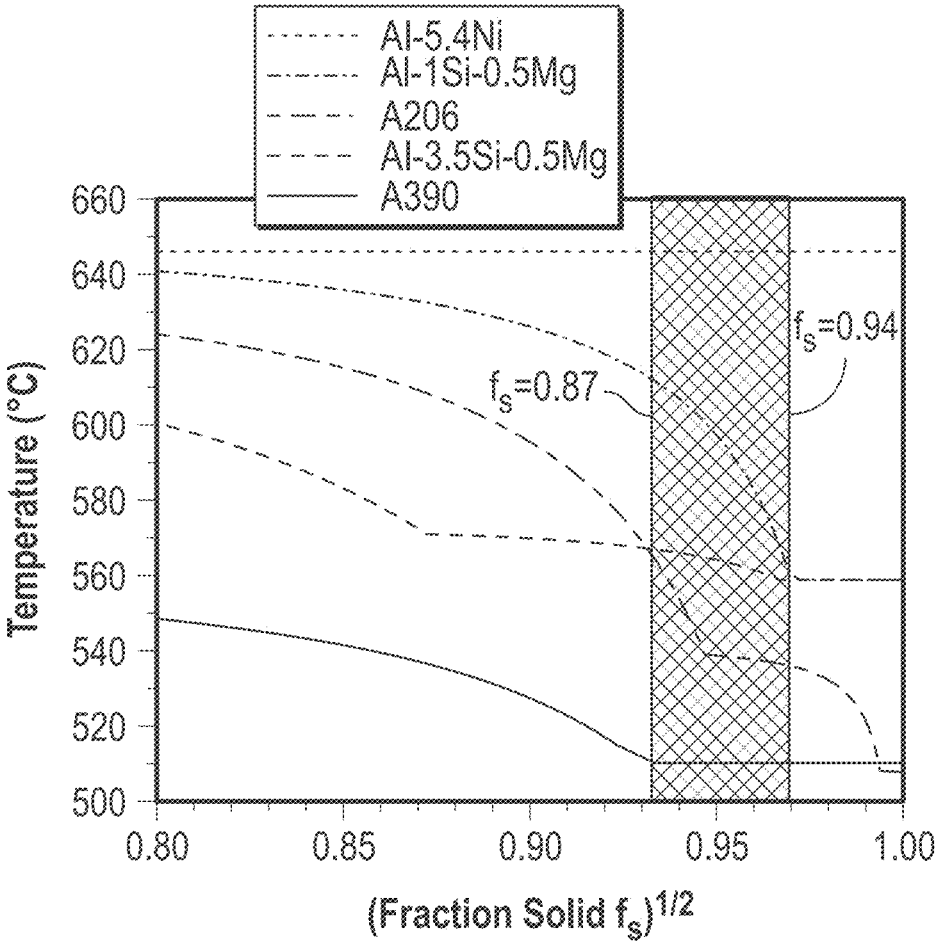
FIG. 10C is a line graph that summarizes computational experiments used to determine the temperature dependence as a function of solid fraction for different alloy compositions.

FIG. 10C summarizes computational experiments that analyzed the temperature dependence as a function of solid fraction for different compositions according to aspects of the present disclosure. Hot-tearing was predicted to occur in the late stages of solidification in the remaining liquid that is present at the interdendritic boundaries. Tearing typically occurs between 80-100% solid. The greater the temperature change within this region, the more time that is spent the alloy spends in this region and the greater the probability of experiencing tearing. As shown in FIG. 10C, the aluminum alloy with 5.4% nickel exhibited little dependence on the fraction solid and thus less probability of experiencing tearing. Additional computational experiments indicate that an aluminum alloy with nickel in the range of 4.3-6 weight percent similarly experienced a small temperature range within the region of 80-100% solid.

Figure 11:
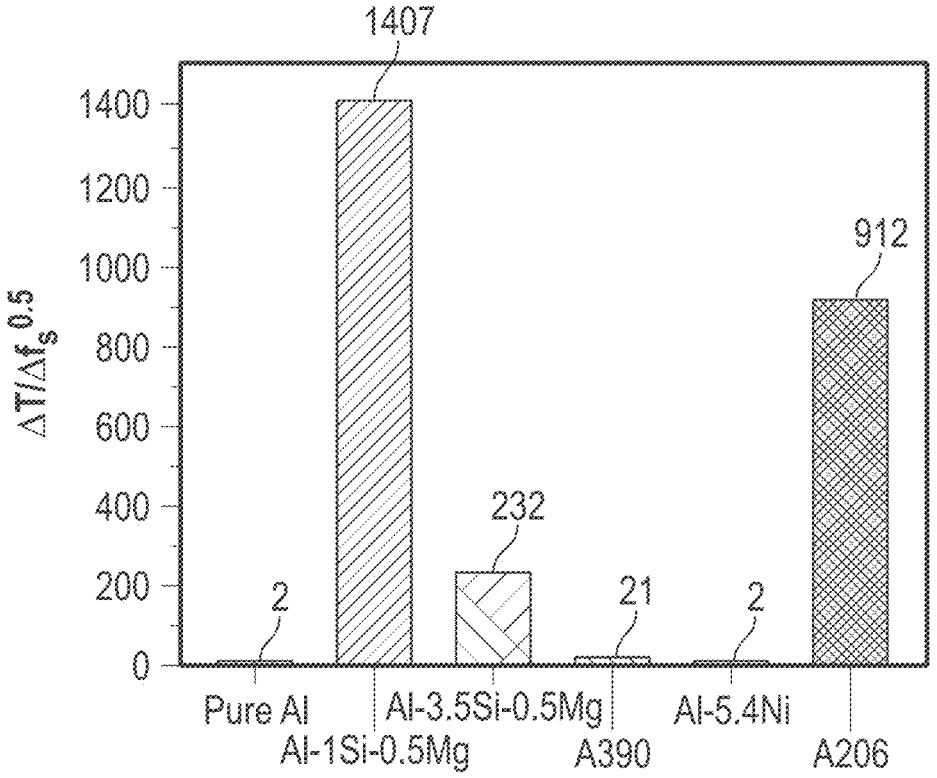
FIG. 11 is a bar chart that summarizes computational experiments of temperature over solid fraction for different alloy compositions.

FIG. 11 illustrates these results as a ratio of the temperature over the 0.5 fraction solid. FIG. 11 summarizes certain computational data of FIG. 10C, where the slope of T vs. $Fs^{1/2}$ is tabulated as per Kou's criterion for an $Fs^{1/2}$ range from 0.87-0.94. This range is chosen because hot-tearing occurs during the final stages of solidification. A lower slope indicates that the alloy will spend less time in the critical zone, and thus be less likely to experience hot tearing. Essentially at a fixed strain rate, if the less time an alloy spends in the critical period, the less the total accumulated strain. The aluminum alloy with 5.4% nickel exhibited a slope of only 2, indicating that it is accumulating less strain than other allows during the solidification process. Thus, it is less likely to experience hot tearing.

Figure 12:
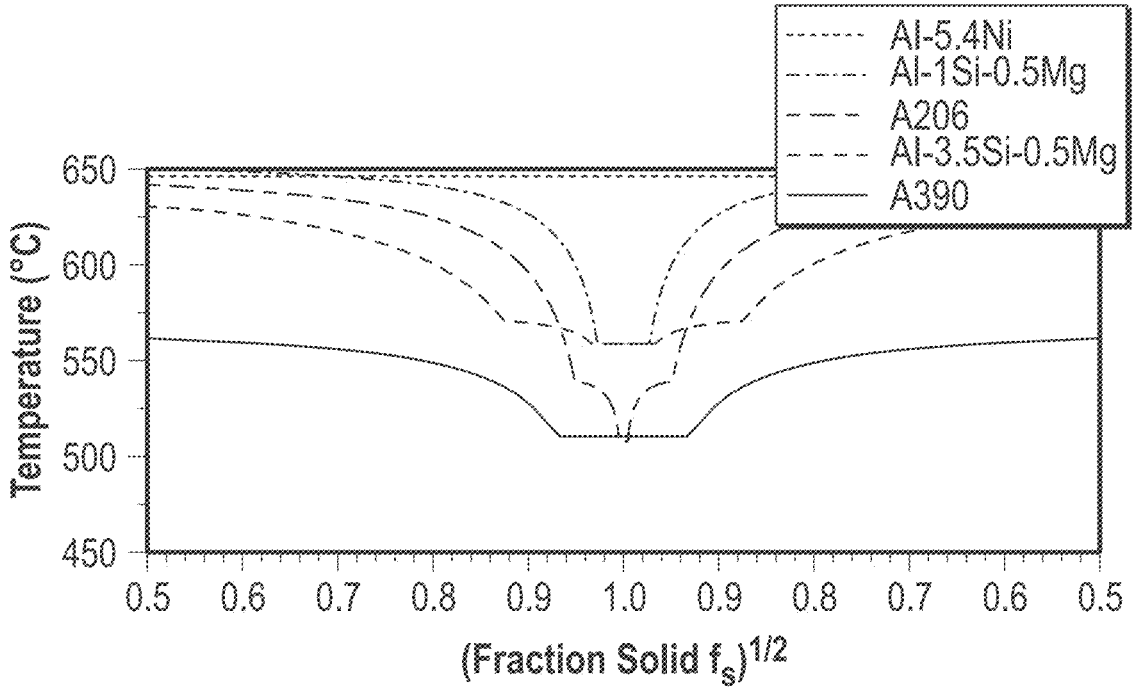
FIG. 12 is a line graph that summarizes computational experiments of temperature over solid fraction for different alloy compositions.

FIG. 12 summarizes computational simulation experiments of temperature over solid fraction for different compositions according to aspects of the present disclosure. FIG. 12 essentially shows the width of the feeding channel between two grains. The wider the feeding channel, the better chance that liquid to fills any tear and thus the probability of hot tearing is reduced. This is important for feeding and the computational experiments show that the aluminum alloy with 5.4% nickel performs the best. The alloys perform as follows, in increasing channel width: A206<AliSi<A13.5Si<A390<A15.4Ni.

Material Property Experimentations

With the computational experimental data from FIGS. 10A-12, a number of aluminum alloy compositions were created, and their material properties were tested.

The composition for the aluminum alloys of the present disclosure are depicted in Tables 1A-1C below, which were developed using both computational modeling and physical testing of samples. The aluminum alloys have improved castability, increased yield strength and conductivity compared to the traditional cast alloys shown in FIG. 2.

TABLE 1A

| Element | Composition (Weight Percent) |
|---|---|
| Nickel (Ni) | 4.3-6 |
| Iron (Fe) | 0.2-0.8 |
| Other (Total) | <0.2 |
| Aluminum (Al) | Remainder |

TABLE 1B

| Element | Composition (Weight Percent) |
|---|---|
| Nickel (Ni) | 4.3-6 |
| Iron (Fe) | 0.2-0.8 |
| Titanium (Ti) | 0.01-0.1 |
| Other (Total) | <0.2 |
| Aluminum (Al) | Remainder |

TABLE 1C

| Element | Composition (Weight Percent) |
|---|---|
| Nickel (Ni) | 4.3-6 |
| Iron (Fe) | 0.2-0.8 |
| Zirconium | <0.001 |
| Magnesium | <0.01 |
| Copper (Cu) | ≤0.01 |
| Zinc (Zn) | ≤0.01 |
| Chromium (Cr) | <0.005 |
| Vanadium (V) | <0.005 |
| Manganese (Mn) | <0.001 |
| Silicon (Si) | <0.05 |
| Mn + Cr + V | <0.025 |
| Titanium (Ti) | 0.01-0.1 |
| Ca | ≤0.005 |
| Other (Each) | ≤0.01 |
| Other (Total) | ≤0.03 |
| Aluminum (Al) | Remainder |

Figure 4:
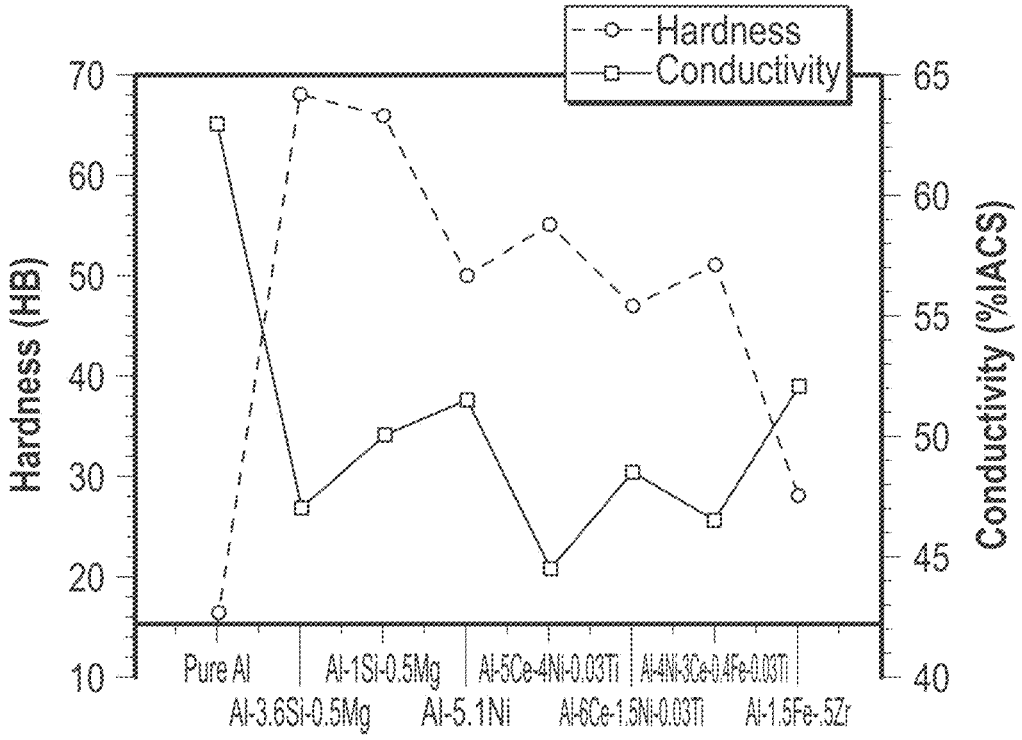
FIG. 4 shows a line plot of experimental hardness and conductivity results of physical coupons of different metal compositions.

FIG. 4 depicts results from the testing of physical samples in which hardness and electrical conductivity measurements were performed. Hardness is related to the yield strength through the relationship of $HV \approx 3\sigma_y$, where HV is the hardness value and $\sigma_y$ is the yield stress.

Yield strengths of the aluminum alloys can be determined indirectly by measuring the hardness value and then calculating the yield stress based on the hardness value. Hardness can be determined via ASTM E18 (Rockwell Hardness), ASTM E92 (Vickers Hardness), or ASTM E103 (Rapid Indentation Hardness) and then calculating the yield strength. Yield strength can also be determined directly via ASTM E8, which covers the testing apparatus, test specimens, and testing procedure for tensile testing. Electrical conductivity of the aluminum alloys may be determined via ASTM E1004, which covers determining electrical conductivity using the electromagnetic (eddy-current) method, or ASTM B 193, which covers determining electrical resistivity of conductor materials.

As shown in FIG. 4, each alloy composition exhibits less conductivity than pure aluminum, but more hardness (meaning that its yield strength is greater). For certain automobile parts, a conductivity of approximately 48% IACS is desirable. The aluminum alloy with 5.1 weight percent of nickel exhibits good conductivity while maintaining a sufficiently-high hardness value. Other physical and computational experiments indicate that a range of nickel compositions from 4.3-6 weight percent will perform similarly and result in conductivity of at least 46% IACS, which is sufficient for certain automobile parts.

Figure 5:
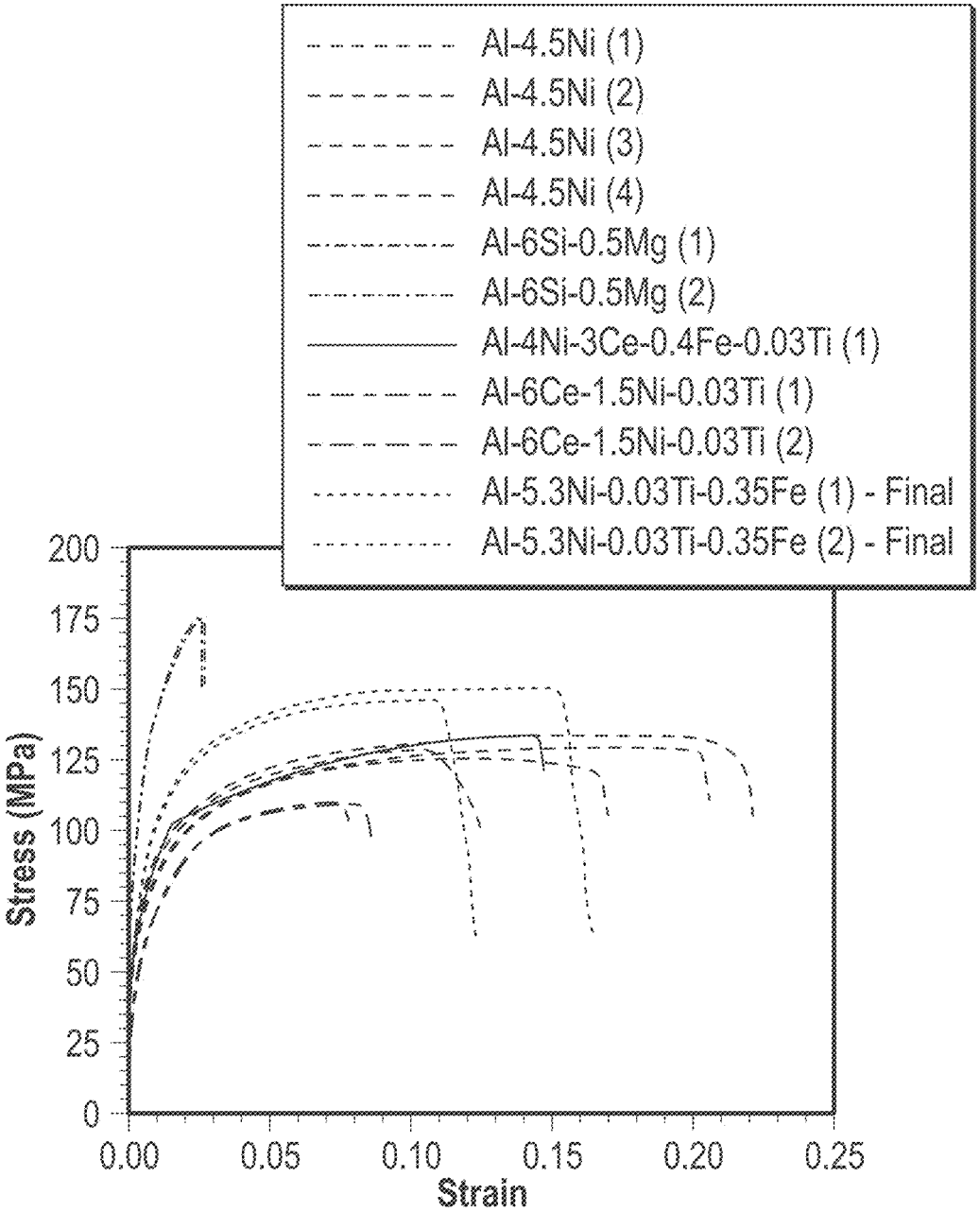
FIG. 5 is a line plot that summarizes experimental stress-strain results of physical coupons of different composition ranges.

FIG. 5 summarizes the results of yield stress measurements for different alloy compositions of the present disclosure. The addition of iron and titanium was found to increase the yield strength of the aluminum-nickel alloy. Physical and computational experiments illustrated that a composition range of iron between 0.2-0.8 weight percent and of titanium between 0.01-0.1 weight percent increases the yield strength of the alloy. This is likely due to iron and titanium precipitates that form throughout the alloy. During cooling of the aluminum alloys that contain iron and/or titanium, different intermetallic phases may form.

Table 2 summarizes experimental results for three different aluminum-alloy compositions: (1) 1% Si, 0.4% Mg, and 0.03% Ti with the remaining percent aluminum; (2) 3.6% Si, 0.04% Mg, and 0.03% Ti with the remaining percent aluminum; and (3) 5.3% Ni, 0.35% Fe, and 0.03% Ti with the remaining percent aluminum. All listed percentages are weight percentages. Different samples were either cast (as cast) and then tested for conductivity, yield strength, and tensile strength; or cast then treated according to the T5 treatment process and then tested for conductivity and yield strength.

The yield strength, ultimate tensile strength (UTS), and conductivity of the alloys shown in Table 2 met minimum requirements for many commercial automobile parts, either as cast or processed according the T5 treatment process. Furthermore, alloys processed via a T6 or T7 treatment process exhibited similarly met the minimum requirements for yield strength, ultimate tensile strength (UTS), and conductivity.

TABLE 2

| Alloy | Al—1Si—0.4Mg—0.03Ti | Al—3.6Si—0.4Mg—0.03Ti | Al—5.3Ni—0.35Fe—0.03Ti |
|---|---|---|---|
| Conductivity (as cast, % IACS) | 50 | 47 | 50 |
| Conductivity (T5 – 225° C./2 hrs, % IACS) | 53 | 50 | Not applicable (NA) |
| Yield strength (as cast, MPa) | 110 | 110 | 90 |
| Yield strength (T5 – 225° C./2 hrs, MPa) | 160 | 150 | Not applicable (NA) |
| UTS (as cast, MPa) | 160 | 170 | 150 |

Figure 6:
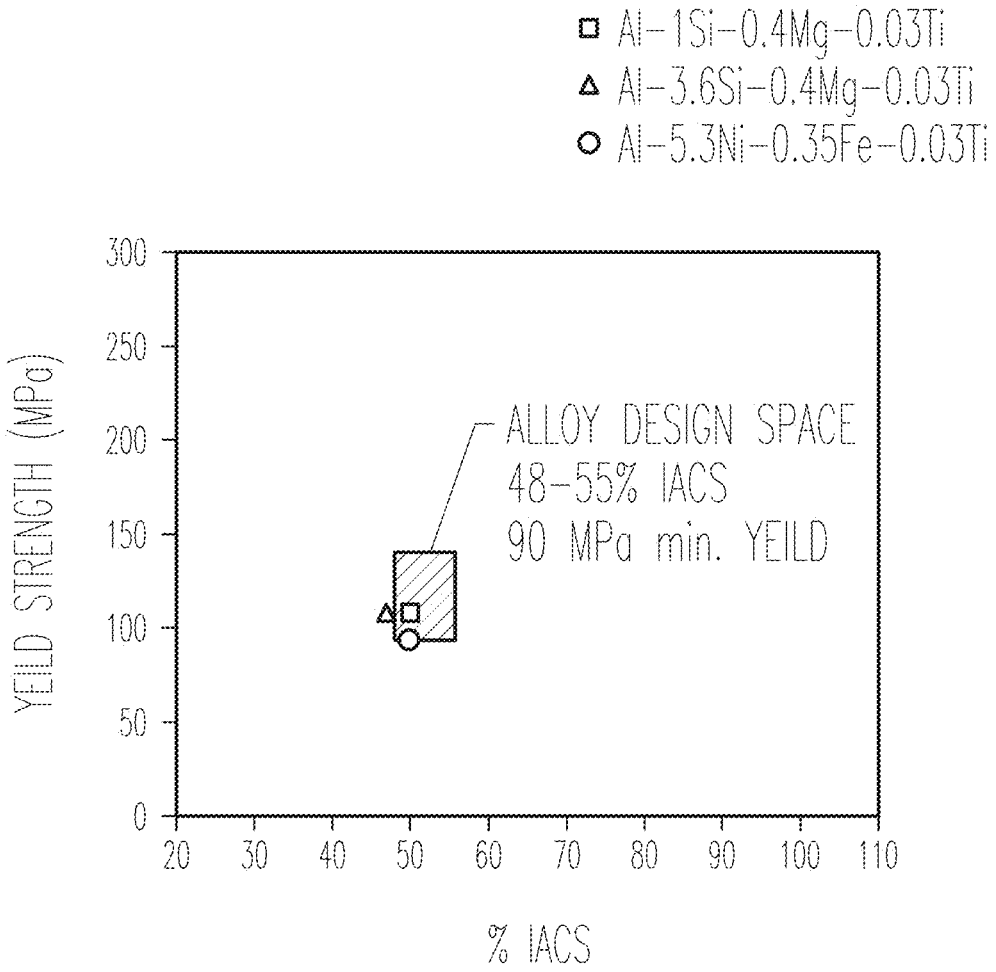
FIG. 6 is a chart that illustrates three aluminum alloys and the alloy design space of the present disclosure on a yield strength verses conductivity plot.

FIG. 6 graphically depicts the yield strengths and electrical conductivities of the alloys shown in Table 2. As seen in FIG. 6, all three cast aluminum alloys have yields strengths and electrical conductivities within or near the alloy design space.

Figure 7:
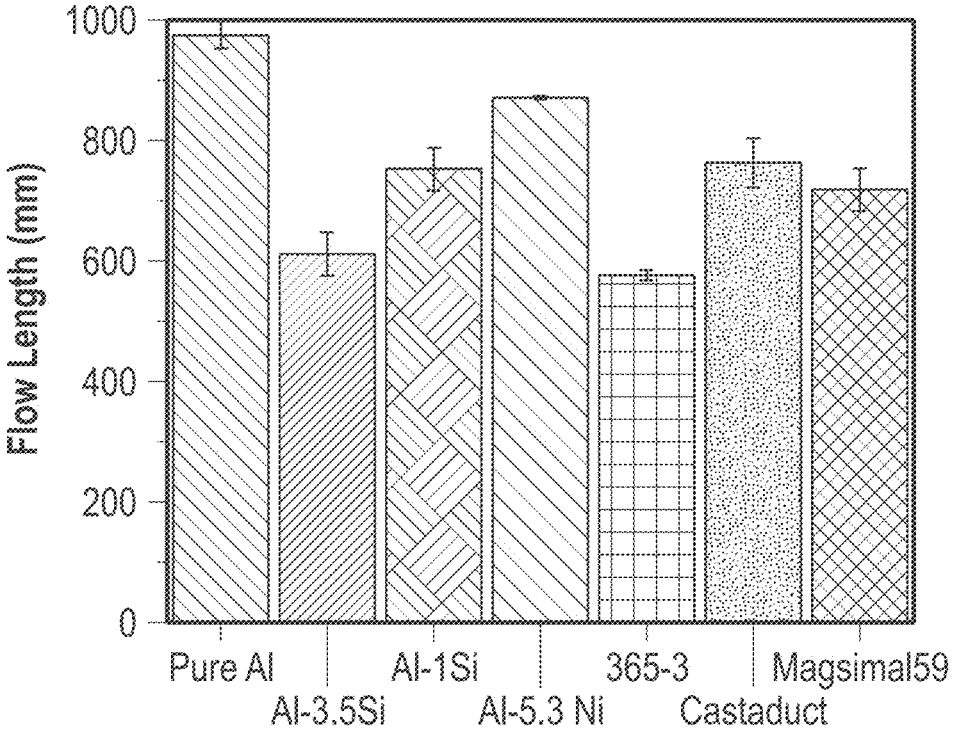
FIG. 7 is a bar chart that summarizes experimental fluidity results of physical coupons of different composition ranges.

FIG. 7 illustrates experimental results from fluidity experiments. When casting parts from an alloy, higher fluidity is general better to ensure that the alloy fully wets the mold and thus a usable part results. In any event, a minimum fluidity is necessary depending on the mold and the part to be manufactured. FIG. 7 illustrates experimental results that show that the aluminum alloy with 5.3% Al—Ni has higher fluidity than the aluminum alloy with 1% Si and the aluminum alloy with 3.% Si (all weight percent). Thus, from a fluidity perspective, the inclusion of nickel enhances fluidity. Computational experiments suggest that fluidity meets necessary levels for many automobile parts and molds when the weight percentage of nickel is between 4.3-6%.

Figure 8:
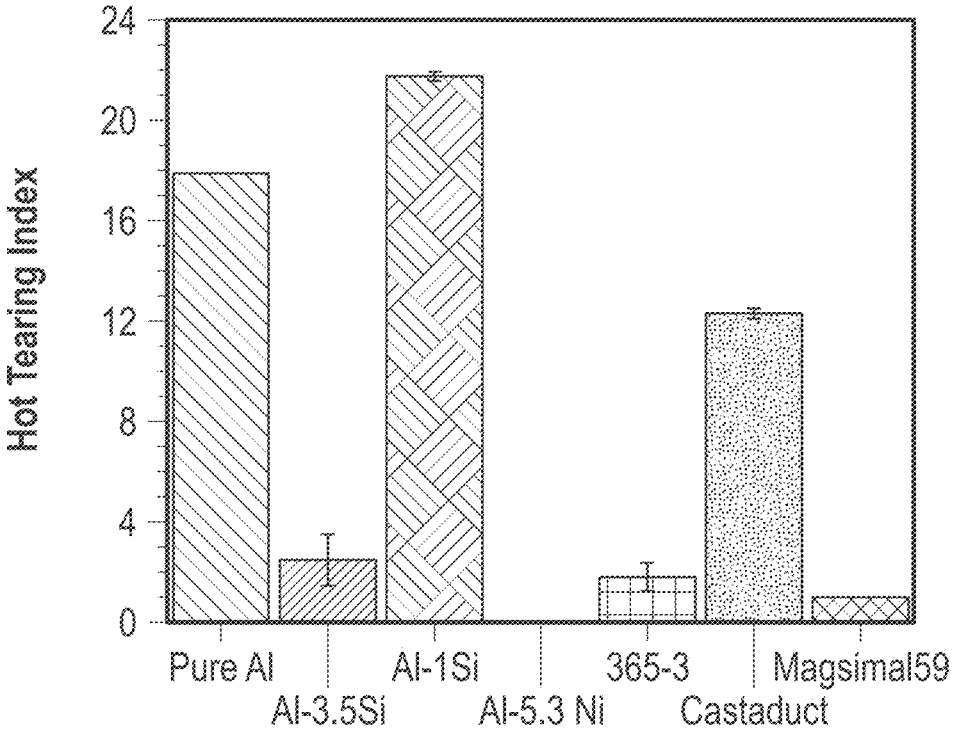
FIG. 8 is a bar chart that summarizes experimental hot-tearing-susceptibility results of physical coupons of different composition ranges.

FIG. 8 illustrates the results of hot tearing susceptibility (HTS) experiments and calculations. The hot tearing susceptibility is the sum over the number of bars of the product of the bar length rating (L) times the crack severity rating (C) for each bar, as shown in the formula below:

$$HTS=\Sigma[(L_i)\times(C_i)]$$

The crack severity rating is shown in Table 3 below.

TABLE 3

| Bar Length Rating | | Crack Severity Rating | |
|---|---|---|---|
| Bar Length (cm) | $L_l$ | Hot Tear Type | $C_l$ |
| 27.5 | 1.00 | No Hot Tear | 0 |
| 22.5 | 1.22 | Hair line | 1 |
| 17.5 | 1.57 | Light | 2 |
| 12.5 | 2.20 | Sever | 3 |
| 7.5 | 3.67 | Complete separation | 4 |

As shown in FIG. 8 the aluminum alloy with 5.3% nickel performed very well. Computational experiments suggest that HTS meets necessary levels for many automobile parts and molds when the weight percentage of nickel is between 4.3-6%.

FIG. 9 shows test samples that were formed through die casting, wherein panel A shows a low Si alloy (Al-1Si), panel B shows a high Si alloy (Al-3.55i), panel C shows pure Al, and panel D shows a Ni alloy (Al-5.3Ni-0.3Fe-0.03Ti). As can be observed, the aluminum alloy with 5.3% nickel (as well as 0.3% Fe and 0.03% Ti) shown in panel D did not exhibit any hot tearing during experiments.

However, the as cast alloy with 1% Si shown in panel A and the pure Al cast shown in panel C both show hot tearing and cracking, as indicated by the circled portions of the images. Thus, the alloy and metal shown in panels A and C are shown to be highly susceptible to hot tearing, which would create low yield strength manufactured parts.

As can also be observed, the aluminum alloy with 3.5% silicon shown in panel B did not exhibit sufficient fluidity to fully wet the experimental mold, and therefore the cast alloy did not fully extend to the circled end of the mold. Thus, the cast part shown in panel B was incomplete, suggesting that the fluidity of the alloy would create challenge for casting manufactured parts.

As demonstrated by FIG. 9, the aluminum alloy with 5.3% nickel shown in panel D was the only cast metal shown to be acceptable for use in cast manufactured parts.

In the foregoing specification, the disclosure has been described with reference to specific embodiments. However, as one skilled in the art will appreciate, various embodiments disclosed herein can be modified or otherwise implemented in various other ways without departing from the spirit and scope of the disclosure. Accordingly, this description is to be considered as illustrative and is for the purpose of teaching those skilled in the art the manner of making and using various embodiments of the disclosed system, method, and computer program product. It is to be understood that the forms of disclosure herein shown and described are to be taken as representative embodiments. Equivalent elements, materials, processes or steps may be substituted for those representatively illustrated and described herein. Moreover, certain features of the disclosure may be utilized independently of the use of other features, all as would be apparent to one skilled in the art after having the benefit of this description of the disclosure.

As used herein, the terms "comprises," "comprising," "includes," "including," "has," "having" or any contextual variants thereof, are intended to cover a non-exclusive inclusion. For example, a process, product, article, or apparatus that comprises a list of elements is not necessarily limited to only those elements, but may include other elements not expressly listed or inherent to such process, product, article, or apparatus. Further, unless expressly stated to the contrary, "or" refers to an inclusive or and not to an exclusive or. For example, a condition "A or B" is satisfied by any one of the following: A is true (or present) and B is false (or not present), A is false (or not present) and B is true (or present), and both A and B is true (or present).

Although the steps, operations, or computations may be presented in a specific order, this order may be changed in different embodiments. In some embodiments, to the extent multiple steps are shown as sequential in this specification, some combination of such steps in alternative embodiments may be performed at the same time. The sequence of operations described herein can be interrupted, suspended, reversed, or otherwise controlled by another process.

It will also be appreciated that one or more of the elements depicted in the drawings/figures can also be implemented in a more separated or integrated manner, or even removed or rendered as inoperable in certain cases, as is useful in accordance with a particular application. Additionally, any signal arrows in the drawings/figures should be considered only as exemplary, and not limiting, unless otherwise specifically noted.

What is claimed is:

1. A cast aluminum alloy comprising:

Ni from 4 to 6 wt %;

Fe from 0.2 to 0.8 wt %; and aluminum, wherein the alloy has a yield strength of at least about 90 MPa and an electrical conductivity of at least about 48% IACS, wherein the alloy is cast as a rotor for an electric motor.

2. The alloy of claim 1, comprising Fe from 0.25 to 0.7 wt %.

3. The alloy of claim 2, comprising Fe of about 0.3 wt %.

4. The alloy of claim 1, further comprising Ti from 0.01 to 0.1 wt %.

5. The alloy of claim 4, comprising Ti of about 0.03 wt %.

6. The alloy of claim 1, comprising Ni from 4.3 to 6 wt %.

7. The alloy of claim 1, comprising Ni from 5 to 5.5 wt %.

8. The alloy of claim 1, comprising Ni of about 5.3 wt %.

9. The alloy of claim 1, comprising Ni of about 5.1 wt %.

10. The alloy of claim 1, comprising Ni of about 5.3 wt %, Fe of about 0.3 wt %, and Ti of about 0.03 wt %.

11. The alloy of claim 1, wherein the alloy comprises a total of incidental impurities of at most about 1 wt %.

12. The alloy of claim 11, wherein the incidental impurity is Si.

13. The alloy of claim 1, wherein the alloy is substantially absent of Si.

14. The alloy of claim 1, wherein the rotor consists essentially of the alloy.

15. The alloy of claim 1, further comprising less than 0.05 wt % Si.

16. The alloy of claim 1, wherein the alloy is in an as-cast state.

17. A cast aluminum alloy comprising:

Ni from 4 to 6 wt %;

Si less than 0.05 wt %; and aluminum, wherein the alloy has a yield strength of at least about 90 MPa and an electrical conductivity of at least about 48% IACS, wherein the alloy is cast as a rotor for an electric motor.

18. A rotor of an electric motor comprising the alloy of claim 1.

19. A method for producing an aluminum alloy, the method comprising:

forming a melt that comprises an aluminum alloy according to claim 1; and casting the melt into a rotor for an electric motor; and aging the cast melt according to a T5 process.

20. The method of claim 19, wherein the aluminum alloy comprises Ni of about 5.3 wt %, Fe of about 0.3 wt %, and Ti of about 0.03 wt %.

* * * * *